US009287652B2

(12) United States Patent
Torii et al.

(10) Patent No.: US 9,287,652 B2
(45) Date of Patent: Mar. 15, 2016

(54) COVER-FITTED CONNECTOR

(71) Applicant: Yazaki Corporation, Tokyo (JP)

(72) Inventors: Chieko Torii, Makinohara (JP); Nozomi Tsurukubo, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/489,567

(22) Filed: Sep. 18, 2014

(65) Prior Publication Data

US 2015/0037988 A1 Feb. 5, 2015

Related U.S. Application Data

(63) Continuation of application No. 14/240,163, filed as application No. PCT/JP2012/005034 on Aug. 8, 2012, now abandoned.

(30) Foreign Application Priority Data

Aug. 24, 2011 (JP) ..... 2011-182298

(51) Int. Cl.
*H01R 13/639* (2006.01)
*H01R 13/516* (2006.01)
(Continued)

(52) U.S. Cl.
CPC ..... *H01R 13/516* (2013.01); *H01R 13/506* (2013.01); *H01R 13/5812* (2013.01); *H01R 13/5829* (2013.01); *H01R 13/639* (2013.01)

(58) Field of Classification Search
CPC ..... H01R 13/516; H01R 13/5812; H01R 13/506; H01R 13/5829
USPC ..... 439/470, 465, 466, 467, 596, 136
See application file for complete search history.

(56) References Cited

U.S. PATENT DOCUMENTS 5,391,092 A * 2/1995 Sumida ..... H01R 13/582 439/470
5,908,327 A * 6/1999 Tsuji ..... H01R 13/506 439/470

(Continued)

FOREIGN PATENT DOCUMENTS

CN 1197314 A 10/1998
JP 11-144796 A 5/1999

(Continued)

OTHER PUBLICATIONS

International Search Report of PCT/JP2012/005034 dated Nov. 13, 2012.

(Continued)

*Primary Examiner* — Abdullah Riyami
*Assistant Examiner* — Harshad Patel
(74) *Attorney, Agent, or Firm* — Sughrue Mion, PLLC

(57) ABSTRACT

A cover-fitted connector includes a connector housing that houses a terminal connected to a terminal of an electric wire, and a cover that covers the electric wire pulled out from the connector housing. The connector housing includes a connector housing body, and a connecting portion connected to the connector housing body. The cover includes a cover body, a connected portion connected with the connecting portion at a time of mating the cover with the connector housing, and a cutout portion having an end portion positioned at a boundary between the connector housing body to cover the connecting portion and configured to expose the connector housing body outside the cover at the time of mating the cover with the connector housing.

5 Claims, 4 Drawing Sheets

(51) Int. Cl.
*H01R 13/58* (2006.01)
*H01R 13/506* (2006.01)

(56) References Cited

U.S. PATENT DOCUMENTS

| | | | | |
|---|---|---|---|---|
| 5,967,830 | A * | 10/1999 | Tsuji | H01R 13/506 439/467 |
| 6,019,638 | A | 2/2000 | Saka et al. | |
| 6,203,362 | B1 * | 3/2001 | Tsuji | H01R 13/506 439/470 |
| 6,364,693 | B1 * | 4/2002 | Stagg | H01R 13/64 439/466 |
| 6,461,201 | B1 | 10/2002 | Maeda et al. | |
| 6,846,191 | B2 * | 1/2005 | Hobbs | H01R 13/4538 439/140 |
| 6,962,504 | B2 * | 11/2005 | Fukui | H01R 13/567 439/466 |
| 7,476,121 | B2 * | 1/2009 | Tsuji | H01R 13/4223 439/465 |
| 2002/0009932 | A1 | 1/2002 | Inaba et al. | |

FOREIGN PATENT DOCUMENTS

| | | | |
|---|---|---|---|
| JP | 2001-143812 | A | 5/2001 |
| JP | 2001-185318 | A | 7/2001 |
| JP | 2002-025685 | A | 1/2002 |
| JP | 2008-293810 | A | 12/2008 |

OTHER PUBLICATIONS

Communication dated Dec. 23, 2014 from the Korean Intellectual Property Office in counterpart application No. 10-2014-7007591.

Communication dated Apr. 8, 2015 from the Canadian Intellectual Property Office in counterpart application No. 2845685.

Communication dated Jun. 30, 2015 from the State Intellectual Property Office of the People's Republic of China in counterpart application No. 201280040108.2.

Communication dated Dec. 9, 2015, issued by the State Intellectual Property Office of the P.R.C. in counterpart Chinese Application No. 201280040108.2.

* cited by examiner

COVER-FITTED CONNECTOR

CROSS REFERENCE TO RELATED APPLICATIONS

This is a Continuation of U. S. Application No. 14/240,163 filed Feb. 21, 2014, which is a National Stage of International Application No. PCT/JP2012/005034 filed Aug. 8, 2012, claiming priority based on Japanese Patent Application No. 2011-182298 filed Aug. 24, 2011, the contents of all of which are incorporated herein by reference in their entirety.

TECHNICAL FIELD

The present invention relates to a cover-fitted connector provided with a cover for covering and protecting an electric wire pulled out from a connector housing.

BACKGROUND ART

Conventionally, as a cover-fitted connector provided with a cover for covering and protecting an electric wire pulled out from a connector housing, for example, one described in Japanese Patent Application Laid-Open Publication No. 2002-25685 (PTL 1) is given.

The conventional cover-fitted connector includes a connector housing for housing a terminal connected to a terminal of an electric wire, and a protective cover adapted to be mated with the connector housing and configured to cover the electric wire pulled out from the connector housing.

The connector housing has a through lock portion for leading out the electric wire, a terminal housing chamber for housing the terminal connected to the terminal of the electric wire, and a mating opening configured to be mated with a counterpart connector in which a counterpart terminal to be connected with the terminal housed in the terminal housing chamber is housed.

The protective cover has a base bottom portion for covering the through lock portion of the connector housing, and a cover portion connected with the base bottom portion via a hinge and so configured that covering the cover portion on the base bottom portion side allows the cover portion to open and close relative to the base bottom portion.

With the conventional cover-fitted connector having the above structure, the through lock portion of the connector housing is assembled to the base bottom portion and the cover portion is covered on the base bottom portion side, to thereby mate the protective cover with the connector housing in such a manner as to cover the through lock portion.

CITATION LIST

Patent Literature

[PTL 1]
Japanese Patent Application Laid-Open Publication No. 2002-25685

SUMMARY OF INVENTION

Technical Problem

Incidentally, the conventional cover-fitted connector described above has such a structure that the protective cover is mated with the connector housing by use of the through lock portion of the connector housing. In addition, for preventing loss of function of the through lock portion, the protective cover is so configured as to cover the entirety of the through lock portion with an allowance, thereby making it possible to partly expose the through lock portion from an opening portion of the protective cover.

Due to this, it is necessary that the protective cover be made larger in external configuration than the through lock portion of the connector housing. Thus, with the conventional cover-fitted connector having the protective cover mated with the through lock portion, a portion of the protective cover for the through lock portion becomes slightly larger in its entirely, making it necessary for the counterpart to which the connector housing is mounted via the through lock portion to provide a large mounting space. Therefore, it has been desired that enlargement of the cover-fitted connector be suppressed as much as possible.

It is therefore an object of the present invention to provide a cover-fitted connector capable of suppressing enlargement of the cover-fitted connector when a cover is mated with a connector housing.

Solution to Problem

According to one aspect of the present invention, there is provided a cover-fitted connector including: a connector housing that houses a terminal connected to a terminal of an electric wire; and a cover configured to be mated with the connector housing and to cover the electric wire pulled out from the connector housing, wherein the connector housing including: a connector housing body, and a connecting portion connected to the connector housing body and provided at an outer portion of the connector housing body, the cover including: a cover body, a connected portion provided in the cover body and configured to be connected with the connecting portion at a time of mating the cover with the connector housing, a cutout portion formed at the cover body, the cutout portion having an end portion positioned at a boundary between the connector housing body and the connecting portion to cover the connecting portion at the time of mating the cover with the connector housing, and the cutout portion configured to expose the connector housing body outside the cover at the time of mating the cover with the connector housing, and a lead-out opening portion formed at the cover body and configured to lead out the electric wire outside the cover body at the time of mating the cover with the connector housing.

According to one aspect of the present invention, the connecting portions are provided at the connector housing so as to be axisymmetric, and the connected portions are provided at the cover so as to be axisymmetric, and the connecting portions and the connected portions are connectable with each other when the cover is mated with the connector housing by reversing the cover relative to the connector housing, and the lead-out opening portion leads out the electric wire in a direction different from a direction before the reversing with the cover mated with the connector housing by reversing the cover relative to the connector housing.

According to one aspect of the present invention, the cover body has a concave portion formed adjacent to the cutout portion.

According to one aspect of the present invention, one member of the connector housing and the cover has a restriction rib protruding therefrom in a second direction perpendicular to a first direction for pulling apart the cover mated with the connector housing from the connector housing, the restriction rib linearly extends in a third direction perpendicular to the first direction and the second direction, the other member of the connector housing and the cover has a restriction groove so formed as to correspond to the restriction rib and configured to receive the restriction rib inserted from the third direction at the time of mating the cover with the connector housing, the restriction rib is so formed as to become larger in width in the first direction from a base end to a distal end in the second direction, and the restriction groove and the restriction rib inserted into the restriction groove control the mating and disengaging of the cover relative to the connector housing with the cover being mated with the connector housing.

According to one aspect of the present invention, the one member of the connector housing and the cover has a guide rib extending in the third direction of the restriction rib in parallel with the restriction rib and protruding from the one member in the second direction and, the other member of the connector housing and the cover has a guide groove configured to receive the guide rib inserted from the third direction at the time of mating the cover with the connector housing, and a cross sectional configuration of the restriction rib on a plane perpendicular to the third direction is different from a cross sectional configuration of the guide rib on the plane perpendicular to the third direction.

According to one aspect of the present invention, among the portions of the connector housing caused to interfere with the cover by the mating of the cover with the connector housing, the connecting portion of the connector housing which is connected with the connected portion of the cover body is disposed inside the cover body. In contrast, the connector housing body is exposed outside via the cutout portion of the cover body. Thus, it is substantially only the connecting portion of the connector housing that is covered with the cover body when mating the cover with the connector housing. Thus, it is sufficient that the cover has such a dimension as to have a portion for covering the electric wire led out from the connector housing and a portion for disposing the connected portion. Thus, it is possible to suppress the connector housing's portion covered with the cover to the minimum thereby preventing enlargement of the cover as much as possible, thus making it possible to suppress enlargement of the cover-fitted connector.

Thus, it is possible to provide a cover-fitted connector capable of suppressing enlargement of the cover-fitted connector when a cover is mated with a connector housing.

According to one aspect of the present invention, even when the cover is reversed relative to the connector housing, the connecting portion of the connector housing can be connected with the connected portion of the cover. Thus, mating the cover with the connector housing by reversing the cover can change the direction of the electric wire led out from the lead-out opening portion of the cover into a different direction.

According to one aspect of the present invention, mating the cover with the connector housing allows the concave portion of the cover body to be adjacent to a portion of the connector housing body exposed outside from the cutout portion of the cover body. Thus, hooking a finger and the like with the step formed at the open edge of the concave portion can facilitate operation of connecting and disconnecting of the cover-fitted connector where the cover is mated with the connector housing relative to the counterpart connector and the like.

According to one aspect of the present invention, one member of the connector housing and the cover has the restriction rib that protrudes therefrom in the second direction perpendicular to the first direction for pulling the cover apart from the connector housing, and is so formed as to become larger in width in the first direction from the base end toward the distal end in the second direction. Further, the restriction groove of the other member of the connector housing and the cover is so formed as to correspond to the restriction rib in configuration. Thus, when a torsional force including a tensile force in the direction for pulling the cover apart from the connector housing is applied to the cover, the restriction rib can be prevented from being disengaged from the restriction groove. Thus, the cover holding force against the torsional force can be improved.

According to one aspect of the present invention, the other member of the connector housing and the cover has the guide groove into which a guide rib having a cross sectional configuration different from a cross sectional configuration of the restriction rib is inserted. Thus, due to the difference in mutual cross sectional configurations, it is possible to detect that the cover is mated in an erroneous position in the case in which the restriction rib is caused to be inserted into the guide groove, thus making it possible to prevent the cover from being mated in an erroneous position.

ADVANTAGEOUS EFFECTS OF INVENTION

According to the present invention, it is possible to provide a cover-fitted connector capable of suppressing enlargement of the cover-fitted connector when a cover is mated with a connector housing.

DESCRIPTION OF EMBODIMENTS

Figure 1:
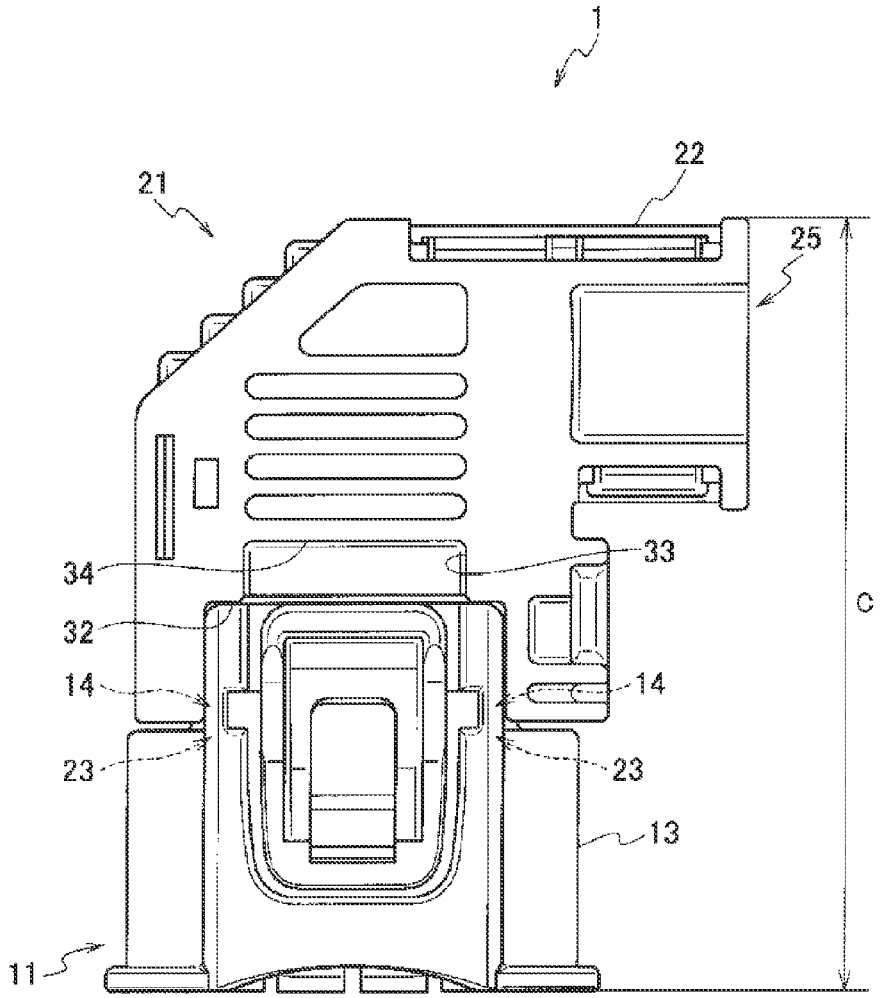
FIG. 1 is a front view illustrative of a cover-fitted connector according to an embodiment of the present invention.

Hereinafter, a cover-fitted connector according to an embodiment of the present invention will be described by referring to drawings. First, referring to FIG. 1, a cover-fitted connector according to the embodiment of the present invention will be described.

A cover-fitted connector 1 according to the embodiment of the present invention is provided with a connector housing 11 for housing a terminal (not shown) connected to a terminal of an electric wire and a cover 21 so mated with the connector housing 11 as to cover an electric wire (not shown) pulled out from the connector housing 11.

Next, referring to FIG. 2, the connector housing 11 which constitutes a part of the cover-fitted connector 1 according to the embodiment of the present invention will be described in detail. FIG. 2 is a plan view illustrative of the connector housing 11 in FIG. 1.

As shown in FIG. 2, the connector housing 11 has a connector housing body 13 having a terminal housing chamber 12 for housing a plurality of terminals, and a connecting portion 14 connected to the connector housing body 13 and disposed at an outer portion of the connector housing body 13.

The connector housing body 13 has an insertion opening 15 into which a counterpart connector housing (not shown)

which houses a terminal to be connected with a plurality of terminals (not shown) housed in the terminal housing chamber 12.

In order to mate the cover 21 (to be described below) in FIG. 3 with the connector housing 11, the connecting portion 14 is disposed at a side of the connector housing body 13 (each of right and left sides in the upper portion in FIG. 2) to which the cover 21 is mated. Each connecting portion 14 has a restriction rib 16 and a guide rib 17.

The restriction rib 16 protrudes from the connector housing 11 in a protruding direction (direction of arrow X and arrow X' in FIG. 2: second direction) which is perpendicular to a pulling apart direction (direction of arrow Y in FIG. 2: first direction) for pulling apart from the connector housing body 13 the cover 21 (refer to FIG. 3 to be described below) mated with the connector housing 11. And the restriction rib 16 linearly extends in an extending direction (direction of arrow Z in FIG. 2: third direction) perpendicular to each of the protruding direction (direction of arrow X and arrow X' in FIG. 2) and the pulling apart direction (direction of arrow Y in FIG. 2) for pulling the cover 21 apart from the connector housing 11. Further, the restriction rib 16 is so formed as to become larger in width from a base end 16*a* toward a distal end 16*b* in the protruding direction (direction of arrow X and arrow X' in FIG. 2).

Inserting the restriction rib 16 from an end portion 16*c* into a restriction groove 26 of the cover 21, which will be described later by referring to FIG. 3, allows the restriction rib 16 to control, in cooperation with the restriction groove 26, mating and disengaging of the cover 21 relative to the connector housing 11.

Figure 2:
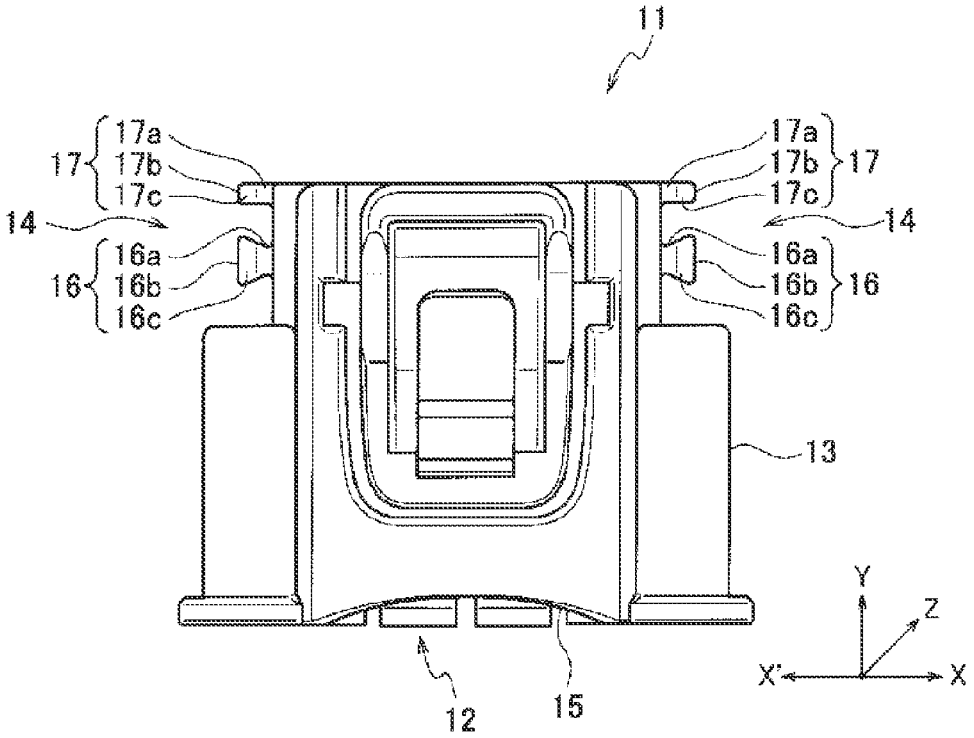
FIG. 2 is a plan view illustrative of a connector housing in FIG. 1.

Further, the guide rib 17, as shown in FIG. 1 and FIG. 2, protrudes from the connector housing body 13 in a direction (direction of arrow X and arrow X' in FIG. 2) same as the protruding direction (direction of arrow X and arrow X' in FIG. 2) of the restriction rib 16. And the guide rib 17 linearly extends, in parallel with the restriction rib 16, in a direction (direction of arrow Z in FIG. 2) perpendicular to both the protruding direction (direction of arrow X and arrow X' in FIG. 2) and the pulling apart direction (direction of arrow Y in FIG. 2) for pulling the cover 21 apart from the connector housing 11. Further, as shown in FIG. 2, the guide rib 17 is so formed as to have the same width from a base end 17*a* to a distal end 17*b* in the protruding direction (direction of arrow X and arrow X' in FIG. 2).

When the restriction rib 16 is inserted into the restriction groove 26 (shown in FIG. 3) of the cover 21 from the end portion 16*c*, the guide rib 17 is inserted into a guide groove 27 (shown in FIG. 3) of the cover 21 from an end portion 17*c* (refer to FIG. 2).

The restriction rib 16 and the guide rib 17 are formed such that respective cross sectional configurations perpendicular to the respective extending directions (direction of arrow Z in FIG. 2) are different from each other. That is, the cross sectional configuration of the restriction rib 16 is substantially trapezoidal while the cross sectional configuration of the guide rib 17 is substantially rectangular.

Next, referring to FIG. 3, the cover 21 constituting a part of the cover-fitted connector 1 according to the embodiment of the present invention will be described in detail. FIG. 3 is a plan view of a developed state showing the cover 21 according to the embodiment of the present invention.

Figure 3:
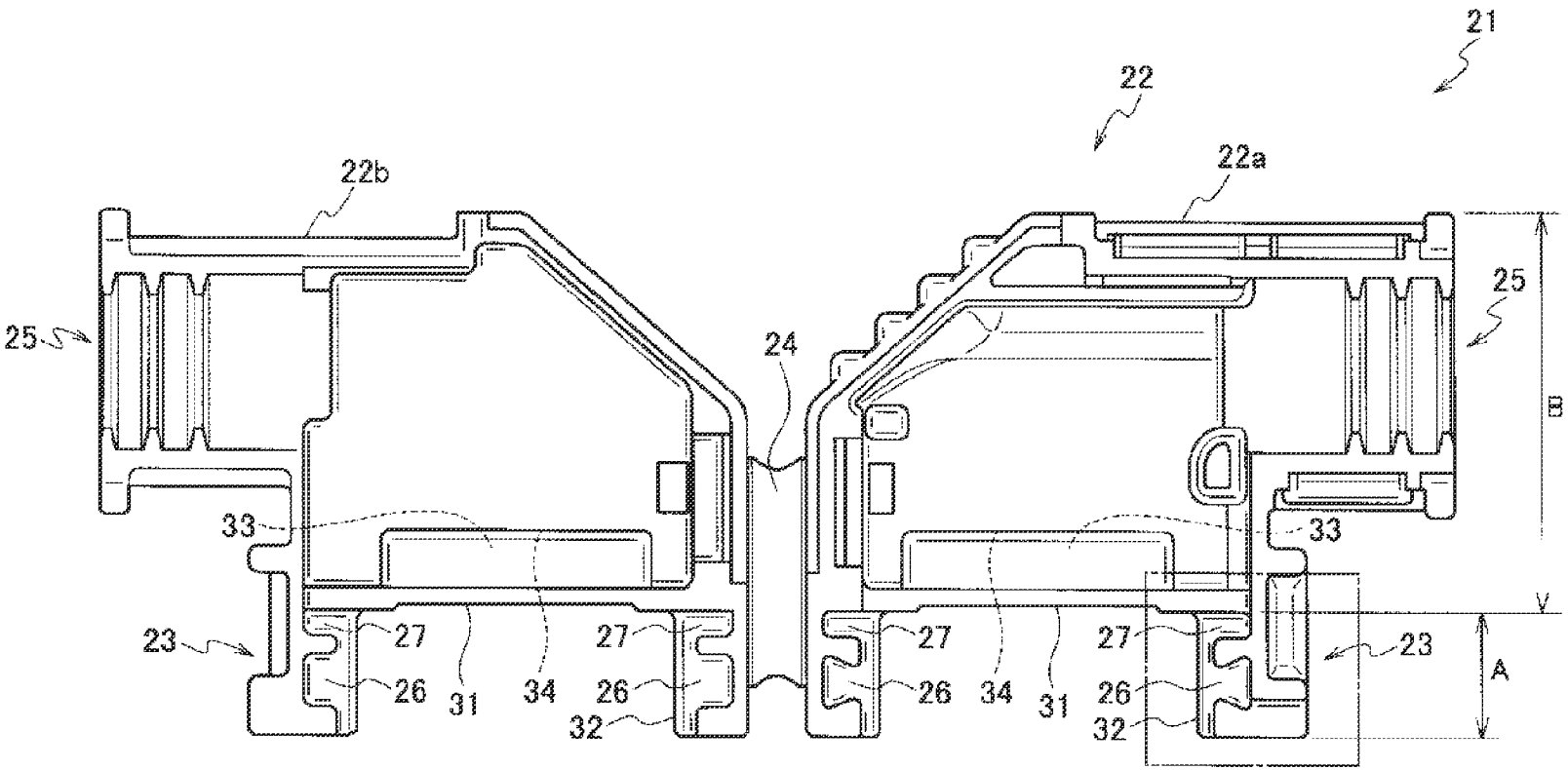
FIG. 3 is a plan view of a developed state showing a cover in FIG. 1.

As shown in FIG. 3, the cover 21 has a cover body 22 and a connected portion 23 which is disposed in the cover body 22 and which is connected with the connecting portion 14 (refer to FIG. 2) at the time of mating the cover 21 with the connector housing 11 (refer to FIG. 1 and FIG. 2).

The cover body 22 has a first cover body 22*a* and a second cover body 22*b*, and the first cover body 22*a* and the second cover body 22*b* are connected with each other via a hinge 24, thus having such a structure that the first cover body 22*a* and second cover body 22*b* which are opened can be folded and overlapped.

A lead-out opening portion 25 in a form of a long thin dome (box shape) for leading out an electric wire (not shown) to the outside of the cover body 22 at the time of mating the cover 21 with the connector housing 11 (refer to FIG. 2) is formed at the cover body 22 (the first cover body 22*a* and the second cover body 22*b*).

Each of the connected portions 23 has a pair of right and left grooves 26 so formed as to correspond to the respective restriction ribs 16 (refer to FIG. 2) and into each of which the restrictions rib 16 is inserted from the end portion 16*c* (refer to FIG. 2) in the extending direction (direction of arrow Z in FIG. 2) of the restriction rib 16 at the time of mating the cover 21 with the connector housing 11 (refer to FIG. 1).

In a state (for example, refer to FIG. 1) where the cover 21 is mated with the connector housing 11 (refer to FIG. 2), the restriction rib 16 inserted from the end portion 16*c* (refer to FIG. 2) controls mating and disengaging of the cover 21 relative to the connector housing 11.

Further, each of the connected portions 23 has a pair of right and left grooves 27 into each of which the guide rib 17 (refer to FIG. 2) is inserted from the end portion 17*c* (refer to FIG. 2) in the extending direction of the guide rib 17 at the time of mating the cover 21 with the connector housing 11 (refer to FIG. 2).

In a state (for example, refer to FIG. 1) where the cover 21 is mated with the connector housing 11 (refer to FIG. 2), the guide rib 17 is inserted into the guide groove 27 from the end portion 17*c* (refer to FIG. 2).

When the connecting portion 14 of the connector housing (refer to FIG. 2) is connected with the connected portion 23 of the cover 21, reversing the cover 21 relative to the connector housing 11 can change the direction of the lead-out opening portion 25 of the cover body 22 relative to the connector housing 11, thus making it possible to lead out the electric wire (not shown) in directions different from each other.

Further, the cover body 22 (the first cover body 22*a* and the second cover body 22*b*) is formed with a cutout portion 32. An end portion 31 of the cutout portion 32 is positioned at a boundary between the connector housing body 13 and the connecting portion 14 (refer to FIG. 2) when the cover 21 is mated with the connector housing 11. Overlapping the first cover body 22*a* with the second cover body 22*b* allows the connecting portion 14 of the connector housing 11, together with the connected portion 23, to be covered with the cover body 22. Even in this state, the connector housing body 13 (refer to FIG. 1) is exposed outside the cover 21.

The cutout portion 32 is disposed at each of the first cover body 22*a* and the second cover body 22*b* such that the connector housing 11 (refer to FIG. 2) can be connected with the cover 21 even when the cover 21 is mated with the connector housing 11 by reversing the cover 21 180-degree angle relative to the connector housing 11.

The cutout portion 32 has a configuration formed by cutting out a portion equivalent to a depth A in an inserting direction for inserting the connector housing (refer to FIG. 2). Mating the cover 21 with the connector housing 11 as shown in FIG. 1 allows the portion equivalent to the depth A to cover the connecting portion 14 of the connector housing 11 and to be positioned to be overlapped with the connecting portion 14. Thus, when the cover 21 is mated with the connector housing 11, the length of the cover 21 is substantially equivalent to a length B shown in FIG. 3.

That is, since the cutout portion 32 has the configuration which is cut out by the portion equivalent to the depth A shown in FIG. 3, the substantial length of the cover 21 with the cover 21 mated with the connector housing 11 becomes shorter by the portion equivalent to the depth A, thus an overall length C (refer to FIG. 1) of the cover-fitted connector 1 becomes shorter by the portion equivalent to the depth A.

Further, the cover body 22 (the first cover body 22*a* and the second cover body 22*b*) has a concave portion 33 formed adjacent to the cutout portion 32.

The concave portion 33 is so configured that hooking a finger and the like with a step formed at an open edge 34 of the concave portion 33 can facilitate operation of connecting and disconnecting of the cover-fitted connector 1 (where the cover 21 is mated with the connector housing 11 (refer to FIG. 1)) relative to a counterpart connector and the like (not shown).

Next, referring to FIG. 4 and FIG. 5 in addition to FIG. 1 to FIG. 3, the mating operation observed when the cover is mated with the connector housing which constitutes a part of the cover-fitted connector according to the embodiment of the present invention will be described, and also described will be operational effect of the cover-fitted connector.

Figure 4:
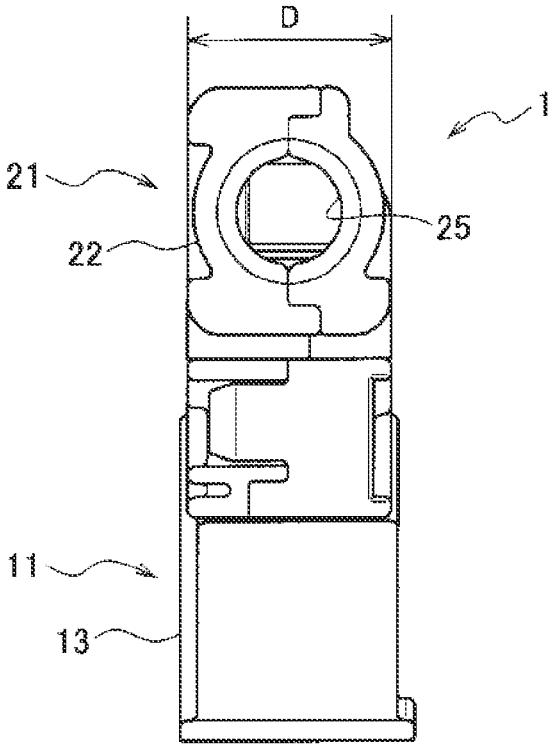
FIG. 4 is a side view illustrative of the cover-fitted connector according to the embodiment of the present invention.

FIG. 4 is a side view illustrative of the cover-fitted connector of FIG. 1. FIG. 5 is a cross sectional view illustrative of the step including the concave portion of FIG. 4.

As shown in FIG. 1 to FIG. 5, the cover 21 is mated with the connector housing 11 into which the counterpart connector housing (not shown) is inserted from the insertion opening 15 (refer to FIG. 2) of the connector housing 11.

Then, the terminal housed in the terminal housing chamber (refer to FIG. 2) of the connector housing 11 is connected to the terminal (not shown) housed in the counterpart connector housing (not shown), and the electric wire (not shown) of the terminal housed in the terminal housing chamber 12 is pulled out from the connector housing 11, to thereby lead out the electric wire (not shown) from the lead-out opening portion 25 (refer to FIG. 3) of the cover 21.

For mating the cover 21 with the connector housing 11, the restriction rib 16 of the connecting portion 14 of the connector housing 11 is inserted from the end portion 16*c* (refer to FIG. 2) into the restriction groove 26 of the connected portion 23 of the first cover body 22*a* or second cover body 22*b* of the cover 21 in the opened state (refer to FIG. 3). Then, when the second cover body 22*b* or first cover body 22*a* is covered to be overlapped with the other, a remaining portion of the restriction rib 16 is inserted into the restriction groove 26 of the connected portion 23 of the second cover body 22*b* or first cover body 22*a*.

With the above operations, the cover 21 is mated with the connector housing 11. In this state, engagement of the restriction groove 26 with the restriction rib 16 inserted into the restriction groove 26 control mating and disengaging of the cover 21 relative to the connector housing 11.

As described above, at the time of mating the cover 21 with the connector housing 11, the cutout portion 32 of the cover body 22 covers the connecting portion 14 (refer to FIG. 2) of the connector housing body 13, and the end portion 31 (refer to FIG. 3) of the cutout portion 32 is positioned at the boundary between the connector housing body 13 and the connecting portion 14, to thereby expose the connector housing body 13 outside the cover 21.

Thus, mating the cover 21 with the connector housing 11 shortens the length of the cover 21 by the portion equivalent to the depth A shown in FIG. 3, allowing the cover 21 to have the length B shown in FIG. 3. With this, as shown in FIG. 1, the overall length C of the cover-fitted connector 1 is shortened by the portion equivalent to the depth A shown in FIG. 3.

Further, since the cutout portion 32 (refer to FIG. 3) is formed at the cover body 22, it is not necessary for the cover 21 to cover the outer periphery of the connector housing 11, thus, as shown in FIG. 4, making it possible to suppress the dimension of a width D of the cover-fitted connector 1 from becoming large.

That is, among portions of the connector housing 11 caused to interfere with the cover 21 by the mating of the cover 21 with the connector housing 11, the connecting portion of the connector housing 11 connected with the connected portion 23 of the cover body 22 is disposed inside the cover body 22. In contrast, the connector housing body 13 is exposed outside via the cutout portion 32 of the cover body 22. Thus, it is substantially only the connecting portion 14 of the connector housing 11 that is covered with the cover body 22 at the time of mating the cover 21 with the connector housing 11.

Thus, it is sufficient that the cover 21 has such a dimension as to have a portion for covering the electric wire led out from the connector housing 11 and a portion for disposing the connected portion 23. Thus, it is possible to suppress the portion of the cover 21 for covering the connector housing 11 to the minimum, thereby preventing enlargement of the cover 21 as much as possible, thus suppressing enlargement as the cover-fitted connector 1.

Further, as described above, even when the cover 21 is reversed 180-degree angle relative to the connector housing 11, the connecting portion 14 of the connector housing 11 can be connected with the connected portion 23 of the cover 21. Thus, mating the cover 21 with the connector housing 11 by reversing the cover 21 180-degree angle can change the direction of the electric wire led out from the lead-out opening portion 25 of the cover 21 into a different direction.

Figure 5:
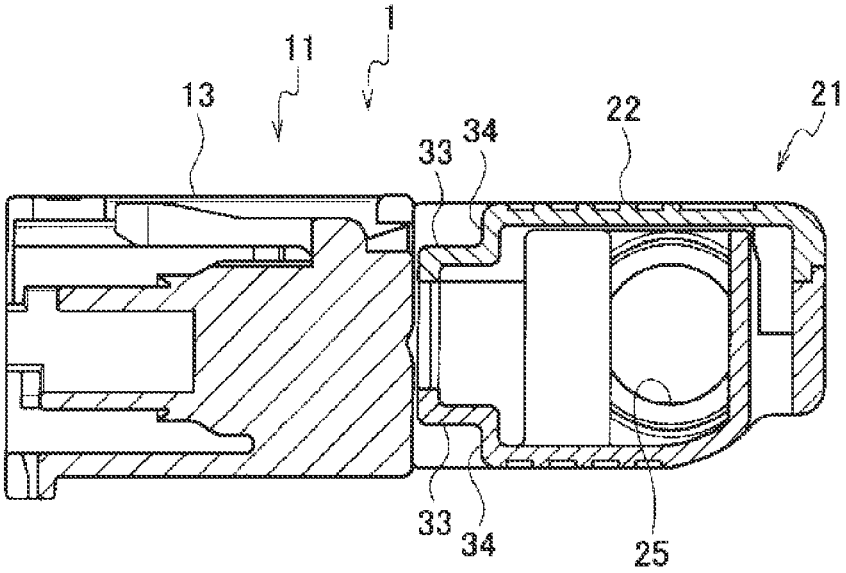
FIG. 5 is across sectional view showing a step of a concave portion constituting a part of the cover-fitted connector according to the embodiment of the present invention.

Further, as shown in FIG. 5, mating the cover 21 with the connector housing 11 allows the concave portion 33 of the cover body 22 to be adjacent to the connector housing body 13 exposed outside from the cutout portion 32 (refer to FIG. 1) of the cover body 22.

Thus, hooking a finger and the like with the step formed at the open edge 34 (refer to FIG. 3) of the concave portion can facilitate operation of connecting and disconnecting of the cover-fitted connector 1 (where the cover 21 is mated with the connector housing 11) relative to the counterpart connector and the like.

As described above, the restriction rib 16 of the connector housing 11 protrudes from the connector housing 11 in the protruding direction (direction of arrow X and arrow X' in FIG. 2) perpendicular to the pulling apart direction (direction of arrow Y in FIG. 2) for pulling the cover 21 apart from the connector housing 11, and it is so formed as to become larger in width from the base end 16*a* toward the distal end 16*b* in the protruding direction (direction of arrow X and arrow X' in FIG. 2) . Further, the restriction groove 26 is so formed at the cover 21 as to correspond to the restriction rib 16 (refer to FIG. 2 and FIG. 3) in its configuration.

Thus, when a torsional force including a tensile force in the direction (direction of arrow Y in FIG. 2) for pulling the cover 21 apart from the connector housing 11 is applied to the cover 21, the restriction rib 16 having a cross section in a form of a wedge with the base end 16*a* side thin and the distal end 16*b* side thick can be prevented from being disengaged from the restriction groove 26 having the corresponding cross sectional configuration (refer to FIG. 2 and FIG. 3). Thus, the cover holding force against the torsional force can be improved.

Further, when the restriction rib 16 of the connecting portion 14 is inserted into the restriction groove 26, the guide rib 17 of the connecting portion 14 is caused to be simultaneously inserted from the end portion 17*c* (refer to FIG. 2) into the guide groove 27 of the connected portion 23 of the first cover body 22*a* or second cover body 22*b* in the developed state (shown in FIG. 3). Then, when the second cover body 22*b* or first cover body 22*a* is caused to be covered to be overlapped with the other, the remaining portion of the guide rib 17 is inserted into the guide groove 27 of the connected portion 23 of the second cover body 22*b* or first cover body 22*a*.

Here, the guide rib 17 and the guide groove 27 each have a cross sectional configuration different from that of the respective restriction rib 16 and restriction groove 26. That is, the cross sectional configuration of the restriction rib 16 is substantially trapezoidal while the cross sectional configuration of the guide rib 17 is substantially rectangular.

Thus, inserting the restriction rib 16 into the guide groove 27 by error cannot be accomplished due to the difference in mutual cross sectional configurations. Thus, mating the cover 21 in an erroneous position can be prevented.

The cover-fitted connector 1 according to the embodiment of the present invention includes: the connector housing 11 that houses the terminal connected to the terminal of the electric wire; and the cover 21 configured to be mated with the connector housing 11 and to cover the electric wire pulled out from the connector housing 11. The connector housing 11 includes: the connector housing body 13, and the connecting portion 14 provided to be connected to the connector housing body 13 and disposed at the outer portion of the connector housing body 13. The cover 21 includes: the cover body 22, the connected portion 23 provided in the cover body 22 and configured to be connected with the connecting portion 14 at the time of mating the cover 21 with the connector housing 11, the cutout portion 32 formed at the cover body 22 having the end portion 31 positioned at the boundary between the connector housing body 13 and the connecting portion 14 to cover the connecting portion 14 at the time of mating the cover 21 with the connector housing 11, the cutout portion 32 configured to expose the connector housing body 13 outside the cover 21 at the time of mating the cover 21 with the connector housing 11, and the lead-out opening portion 25 formed at the cover body 22 and configured to lead out the electric wire outside the cover body 22 at the time of mating the cover 21 with the connector housing 11.

Further, with the cover-fitted connector 1 according to the embodiment of the present invention, the connecting portions 14 are so disposed at the connector housing 11 as to be axisymmetric. The connected portions 23 are so disposed at the cover 21 as to be axisymmetric. Even when the cover 21 is mated with the connector housing 11 by reversing the cover 21 relative to the connector housing 11, the connecting portions 14 and the connected portions 23 are connected with each other. With the cover 21 mated with the connector housing 11 by reversing the cover 21 relative to the connector housing 11, the lead-out opening portion 25 leads out the electric wire in the direction different from the direction before the reversing.

Further, with the cover-fitted connector 1 according to the embodiment of the present invention, the cover body 22 has the concave portion 33 formed adjacent to the cutout portion 32.

In addition, with the cover-fitted connector 1 according to the embodiment of the present invention, the connector housing 11 has the restriction rib 16 protruding from the connector housing 11 in the second direction perpendicular to the first direction for pulling apart the cover 12 mated with the connector housing 11 from the connector housing 11. The restriction rib 16 linearly extends in the third direction perpendicular to the first direction and the second direction. The cover 21 has the restriction groove 26 so formed as to correspond to the restriction rib 16 and configured to receive the restriction rib 16 inserted from the third direction at the time of mating the cover 21 with the connector housing 11. The restriction rib 16 is so formed as to become larger in width in the first direction from the base end 16*a* to the distal end 16*b* in the second direction. The restriction groove 26 and the restriction rib 16 inserted into the restriction groove 26 control the mating and disengaging of the cover 21 relative to the connector housing 11 with the cover 2 mated with the connector housing 11.

Further, with the cover-fitted connector 1 according to the embodiment of the present invention, the connector housing 11 has the guide rib 17 extending in the third direction of the restriction rib 16 in parallel with the restriction rib 16 and protruding from the connector housing 11 in the second direction. The cover 21 has the guide groove 27 configured to receive the guide rib 17 inserted from the third direction at the time of mating the cover 21 with the connector housing 11. The cross sectional configuration of the restriction rib 16 on the plane perpendicular to the third direction is different from the cross sectional configuration of the guide rib 17 on the plane perpendicular to the third direction.

According to the embodiment of the present invention, among portions of the connector housing 11 caused to interfere with the cover 21 by the mating of the cover 21 with the connector housing 11, the connecting portion 14 of the connector housing 11, which is connected with the connected portion 23 of the cover body 22, is disposed inside the cover body 22. In contrast, the connector housing body 13 is exposed outside via the cutout portion 32 of the cover body 22. Thus, it is substantially only the connecting portion 14 of the connector housing 11 that is covered with the cover body 22 at the time of mating the cover 21 with the connector housing 11. Thus, it is sufficient that the cover 21 has such a dimension as to have a portion for covering the electric wire led out from the connector housing 11 and a portion for providing the connected portion 23. Thus, it is possible to suppress a portion of the connector housing 11 covered with the cover 21 to the minimum thereby preventing enlargement of the cover 21 as much as possible, thus suppressing enlargement of the cover-fitted connector 1.

Further, according to the embodiment of the present invention, even when the cover 21 is reversed relative to the connector housing 11, the connecting portion 14 of the connector housing 11 can be connected with the connected portion 23 of the cover 21. Thus, mating the cover 21 with the connector housing 11 by reversing the cover can change the direction of the electric wire led out from the lead-out opening portion 25 of the cover 21 into a different direction.

Further, according to the embodiment of the present invention, when mating the cover 21 with the connector housing 11, the concave portion 33 of the cover body 22 to be adjacent to a portion of the connector housing body 13 being exposed outside from the cutout portion 32 of the cover body 22. Thus, hooking a finger and the like with the step formed at the open edge 34 (refer to FIG. 1 and FIG. 3) of the concave portion 33 can facilitate operation of connecting and disconnecting of the cover-fitted connector 1 (where the cover 21 is mated with the connector housing 11) relative to the counterpart connector and the like.

Further, according to the embodiment of the present invention, the restriction rib 16 of the connector housing 11 protrudes from the connector housing 11 in the second direction (direction of arrow X and arrow X' in FIG. 2) perpendicular to the first direction (direction of arrow Y in FIG. 2) for pulling the cover 21 apart from the connector housing 11, and the restriction rib 16 is so formed as to become larger in width in the first direction from the base end 16*a* toward the distal end 16*b* in the second direction (X and X' in FIG. 2). Also, the restriction groove 26 of the cover 21 is so formed as to correspond to the restriction rib 16 in its configuration. Thus, when a torsional force including a tensile force in the direction (direction of arrow Y in FIG. 2) for pulling the cover 21 apart from the connector housing 11 is applied to the cover 21, the restriction rib 16 can be prevented from being disengaged from the restriction groove 26. Thus, the cover holding force against the torsional force can be improved.

Further, according to the embodiment of the present invention, the connector housing 11 has the guide rib 17 extending in the third direction of the restriction rib 16 in parallel with the restriction rib 16 and protrudes from the connector housing 11 in the second direction. The cover 21 has the guide groove 27 into which the guide rib 17 having the cross sectional configuration different from the cross sectional configuration of the restriction rib 16 is inserted. Thus, inserting the restriction rib 16 into the guide groove 27 cannot be accomplished due to the difference in mutual cross sectional configurations. Thus, mating the cover 21 in an erroneous position can be prevented.

Although the cover-fitted connector of the present invention has been described above based on the embodiment shown in the drawings, the present invention is not limited to this, and the structure of each portion may be substituted with an arbitrary structure having a similar function.

For example, according to the embodiment of the present invention, the description has been made about a case in which the restriction rib 16 is provided at the connector housing 11 and the restriction groove 26 is provided at the cover 21; however, it is also possible to provide the restriction rib 16 at the cover 21 and the restriction groove 26 at the connector housing 11.

Further, for example, according to the embodiment of the present invention, the description has been made for a case in which the guide rib 17 is provided at the connector housing 11 and the guide groove 27 is provided at the cover 21; however, it is also possible to provide the guide rib 17 at the cover 21 and the guide groove 27 at the connector housing 11.

[Industrial Applicability]

The present invention is highly useful to a cover-fitted connector having such a structure that a cover for covering an electric wire pulled out from a connector housing is mated with a connector housing for housing a terminal connected to an electric wire.

REFERENCE SIGNS LIST

1: cover-fitted connector
11: connector housing
12: terminal housing chamber
13: connector housing body
14: connecting portion
15: insertion opening
16: restriction rib
16*a:* base end
16*b:* distal end
17: guide rib
21: cover
22: cover body
23: connected portion
24: hinge
25: lead-out opening portion
26: restriction groove
27: guide groove
31: end portion
32: cutout portion
33: concave portion
34: open edge

The invention claimed is:

1. A cover-fitted connector comprising:
a connector housing that houses a terminal connected to a terminal of an electric wire; and
a cover configured to be mated with the connector housing and to cover the electric wire pulled out from the connector housing,
wherein
the connector housing including:
a connector housing body, and
a connecting portion connected to the connector housing body and provided at an outer portion of the connector housing body, and
the cover including:
a cover body,
a connected portion provided in the cover body and configured to be connected with the connecting portion at a time of mating the cover with the connector housing,
a cutout portion formed at the cover body, the cutout portion having an end portion positioned at a boundary between the connector housing body and the connecting portion to cover the connecting portion at the time of mating the cover with the connector housing, and the cutout portion configured to expose the connector housing body outside the cover at the time of mating the cover with the connector housing, and
a lead-out opening portion formed at the cover body and configured to lead out the electric wire outside the cover body at the time of mating the cover with the connector housing, and wherein
one member of the connector housing and the cover has a restriction rib protruding therefrom in a second direction perpendicular to a first direction for pulling apart the cover mated with the connector housing from the connector housing,
the restriction rib linearly extends in a third direction perpendicular to the first direction and the second direction,
the other member of the connector housing and the cover has a restriction groove so formed as to correspond to the restriction rib and configured to receive the restriction rib inserted from the third direction at the time of mating the cover with the connector housing,
the restriction rib is so formed as to become larger in width in the first direction from a base end to a distal end in the second direction.

2. The cover-fitted connector according to claim 1, wherein:
the connecting portions are provided at the connector housing so as to be axisymmetric,
the connected portions are provided at the cover so as to be axisymmetric,
the connecting portions and the connected portions are connectable with each other when the cover is mated with the connector housing by reversing the cover relative to the connector housing, and
the lead-out opening portion leads out the electric wire in a direction different from a direction before the reversing with the cover mated with the connector housing by reversing the cover relative to the connector housing.

3. The cover-fitted connector according to claim 1, wherein the cover body has a concave portion formed adjacent to the cutout portion.

4. The cover-fitted connector according to claim 1, wherein:

the restriction groove and the restriction rib inserted into the restriction groove control the mating and disengaging of the cover relative to the connector housing with the cover being mated with the connector housing.

5. The cover-fitted connector according to claim 4, wherein:

the one member of the connector housing and the cover has a guide rib extending in the third direction of the restriction rib in parallel with the restriction rib and protruding from the one member in the second direction and, the other member of the connector housing and the cover has a guide groove configured to receive the guide rib inserted from the third direction at the time of mating the cover with the connector housing, and a cross sectional configuration of the restriction rib on a plane perpendicular to the third direction is different from a cross sectional configuration of the guide rib on the plane perpendicular to the third direction.

* * * * *